US006657128B2

(12) United States Patent
Ramarge et al.

(10) Patent No.: US 6,657,128 B2
(45) Date of Patent: Dec. 2, 2003

(54) HYDROPHOBIC PROPERTIES OF POLYMER HOUSINGS

(75) Inventors: Michael M. Ramarge, Olean, NY (US); Thomas C. Hartman, Allegany, NY (US); David R. Miller, Allegany, NY (US); David Servies, South Milwaukee, WI (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 09/771,027

(22) Filed: Jan. 29, 2001

(65) Prior Publication Data

US 2002/0100605 A1 Aug. 1, 2002

(51) Int. Cl.[7] ..... H01B 17/00
(52) U.S. Cl. ..... 174/137 A; 174/178; 174/209
(58) Field of Search ..... 174/137 A, 176, 174/178, 209; 361/117, 118, 126, 127, 134, 112

(56) References Cited

U.S. PATENT DOCUMENTS

| | | | | |
|---|---|---|---|---|
| 4,100,588 A | | 7/1978 | Kresge | 361/127 |
| 4,729,053 A | | 3/1988 | Maier et al. | 361/118 |
| 4,816,959 A | | 3/1989 | Maier et al. | 361/127 |
| 4,851,955 A | | 7/1989 | Doone et al. | 361/117 |
| 4,930,039 A | | 5/1990 | Woodworth et al. | 361/127 |
| 5,041,164 A | * | 8/1991 | Hingorani | 134/22.12 |
| 5,113,306 A | | 5/1992 | Veverka et al. | 361/127 |
| 5,210,676 A | | 5/1993 | Mashikian | 361/117 |
| 5,291,366 A | | 3/1994 | Giese et al. | 361/127 |
| 5,326,804 A | | 7/1994 | Mistry et al. | 524/188 |
| 5,363,266 A | | 11/1994 | Wiseman et al. | 361/127 |
| 5,497,138 A | | 3/1996 | Malpiece et al. | 338/21 |
| 5,594,613 A | | 1/1997 | Woodworth et al. | 361/127 |
| 5,608,597 A | | 3/1997 | Holmstrom et al. | 361/127 |
| 5,625,523 A | | 4/1997 | Nedriga | 361/127 |
| 5,680,289 A | | 10/1997 | Robinson et al. | 361/127 |
| 5,695,841 A | | 12/1997 | Mazeika et al. | 428/36.92 |
| 5,708,555 A | | 1/1998 | Woodworth et al. | 361/127 |
| 5,712,757 A | | 1/1998 | Bennett et al. | 361/127 |
| 5,757,604 A | | 5/1998 | Bennett et al. | 361/127 |
| 5,818,677 A | | 10/1998 | Bennett et al. | 361/127 |
| 5,830,405 A | | 11/1998 | Mazeika et al. | 264/328.2 |
| 5,896,266 A | | 4/1999 | Rubinski | 361/127 |
| 5,912,611 A | | 6/1999 | Berggren et al. | 338/21 |
| 5,936,824 A | | 8/1999 | Carpenter, Jr. | 361/126 |
| 5,936,825 A | | 8/1999 | DuPont | 361/127 |
| 5,936,826 A | | 8/1999 | Schmidt | 361/127 |
| 6,008,975 A | | 12/1999 | Kester et al. | 361/117 |

FOREIGN PATENT DOCUMENTS

| | | |
|---|---|---|
| GB | 2048116 A | 12/1980 |
| WO | WO9967336 | 12/1999 |

OTHER PUBLICATIONS

"Silicone Processor Develops Niche for Insulator Coatings", Insulator News and Market Report, vol. 8, No. 6, Nov./Dec. 2000.

* cited by examiner

*Primary Examiner*—Dean A. Reichard
*Assistant Examiner*—W. David Walkenhorst
(74) *Attorney, Agent, or Firm*—Fish & Richardson P.C.

(57) ABSTRACT

A housing for an electrical apparatus includes a sheath, at least one shed and a hydrophobic coating. The sheath includes a first electrically insulative material and an outer surface. The at least one shed includes a second electrically insulative material and an outer surface. The hydrophobic coating is applied to the outer surface of at least one of the sheath and the at least one shed. One of the first electrically insulative material and the second electrically insulative material includes an electrically insulative, polymeric material.

41 Claims, 11 Drawing Sheets

HYDROPHOBIC PROPERTIES OF POLYMER HOUSINGS

TECHNICAL FIELD

This invention relates to hydrophobic polymer housings used on electrical equipment, such as surge arresters.

BACKGROUND

Electrical transmission and distribution equipment is subject to voltages within a fairly narrow range under normal operating conditions. However, system disturbances, such as lightning strikes and switching surges, may produce momentary or extended voltage levels that greatly exceed the levels experienced by the equipment under normal operating conditions. These voltage variations often are referred to as over-voltage conditions.

If not protected from over-voltage conditions, critical and expensive equipment, such as transformers, switching devices, computer equipment, and electrical machinery, may be damaged or destroyed by over-voltage conditions and associated current surges. Accordingly, it is routine practice for system designers to use surge arresters to protect system components from dangerous over-voltage conditions.

A surge arrester is a protective device that is commonly connected in parallel with a comparatively expensive piece of electrical equipment so as to shunt or divert over-voltage-induced current surges safely around the equipment, and to thereby protect the equipment and its internal circuitry from damage. When exposed to an over-voltage condition, the surge arrester operates in a low impedance mode that provides a current path to electrical ground having a relatively low impedance. The surge arrester otherwise operates in a high impedance mode that provides a current path to ground having a relatively high impedance. The impedance of the current path is substantially lower than the impedance of the equipment being protected by the surge arrester when the surge arrester is operating in the low-impedance mode, and is otherwise substantially higher than the impedance of the protected equipment.

When the over-voltage condition has passed, the surge arrester returns to operation in the high impedance mode. This high impedance mode prevents normal current at the system frequency from flowing through the surge arrester to ground.

Conventional surge arresters typically include an elongated outer enclosure or sheath made of an electrically insulating material, such as porcelain or a polymeric material, a pair of electrical terminals at opposite ends of the enclosure for connecting the arrester between a line-potential conductor and electrical ground, and an array of other electrical components that form a series electrical path between the terminals. These components typically include a stack of voltage-dependent, nonlinear resistive elements, referred to as varistors. A varistor is characterized by having a relatively high impedance when exposed to a normal system frequency voltage, and a much lower resistance when exposed to a larger voltage, such as is associated with over-voltage conditions. In addition to varistors, a surge arrester also may include one or more spark gap assemblies electrically connected in series or parallel with one or more of the varistors. Some arresters also include electrically conductive spacer elements coaxially aligned with the varistors and gap assemblies.

SUMMARY

In one general aspect, a housing for an electrical apparatus includes a sheath, at least one shed, and a hydrophobic coating. The sheath includes a first electrically insulative material and an outer surface. The shed includes a second electrically insulative material and an outer surface. The hydrophobic coating is applied to the outer surface of at least one of the sheath and the shed. One of the first electrically insulative material and the second electrically insulative material includes an electrically insulative, polymeric material.

Implementations may include one or more of the following features. For example, the sheath may be made from a high temperature vulcanizing ("HTV") silicone, the shed may be made from a room temperature vulcanizing ("RTV") silicone, and the coating may be made from one or more of a liquid silicone ("LS") rubber and a RTV silicone. The coating may form a continuous or a non-continuous surface on the outer surface of the sheath and/or on the outer surface of the shed.

The sheath may be made from a HTV silicone, the shed may be made from a RTV silicone, and the coating may be made from one or more of a LS rubber and a RTV silicone. The coating may form a continuous surface or a non-continuous surface on the outer surface of the sheath.

The sheath may be made from a RTV silicone, the shed may be made from a HTV silicone, and the coating may be made from one or more of a LS rubber and a RTV silicone. The coating may form a continuous surface or a non-continuous surface on the outer surface of the shed.

The first electrically insulative material of the sheath may be one or more of an ethylene-propylene-based material, an ethylene vinyl acetate, a cycloaliphatic resin, and an elastomeric or polymeric insulative material, and the coating may be made from one or more of a LS rubber and a RTV silicone. The coating may form a continuous surface or a non-continuous surface on the outer surface of the sheath and/or the outer surface of the shed.

The second electrically insulative material of the at least one shed may be one or more of an ethylene-propylene-based material, an ethylene vinyl acetate, a cycloaliphatic resin, and an elastomeric or polymeric insulative material, and the coating may be made from one or more of a LS rubber and a RTV silicone. Once again, the coating may form a continuous surface or a non-continuous surface on the outer surface of the sheath and/or the outer surface of the shed.

A kit that includes the coating and a coating applicator also may be provided. The kit is designed to be used after the electrical apparatus has been installed in the field and can be used to apply a coating.

The electrical apparatus may include one or more of a transformer, a capacitor, a switch, a recloser, a circuit breaker, a feed through bushing, a suspension insulator, a dead ends insulator, a post insulator, a pin insulator, and a buss support.

In another general aspect, forming a housing for an electrical apparatus includes providing a sheath, providing at least one shed, and applying a hydrophobic coating. The sheath includes a first electrically insulative material and an outer surface. The shed includes a second electrically insulative material and an outer surface. The hydrophobic coating is applied to the outer surface of at least one of the sheath and the shed.

The coating may be applied to the sheath and sheds of the electrical apparatus after the electrical apparatus has been installed. The coating may be periodically applied as part of a maintenance program.

In another general aspect, a housing for an electrical apparatus includes a polymer sheath, at least one polymer shed, and a hydrophobic RTV silicone coating. The polymer sheath is made from an electrically insulative polymeric material and has an outer surface. The polymer shed is integrally attached to the sheath, is made from the electrically insulative polymeric material, and has an outer surface. The hydrophobic RTV silicone coating is applied to the outer surface of the sheath and to the outer surface of the shed.

Implementations may include one or more of the features described above. In addition, the electrically insulative polymeric material may include one or more of a HTV silicone, a polymer concrete, and an ethylene-propylene rubber.

In another general aspect, maintaining a housing for an electrical apparatus that includes a polymer sheath and at least one polymer shed includes providing a hydrophobic coating and applying the hydrophobic coating to at least one of the polymer sheath and the polymer shed. Implementations may include one or more of the features described above. In addition, the coating can include a pigment that colors the coating a first color that is different from a second color of the polymer sheath and maintaining the housing further includes determining the integrity of the coating by looking for breaks in the color of the coating.

The improved housing provides considerable advantages. For example, the hydrophobic coating on the housing causes water to bead on the surface, which reduces or eliminates conductive paths in which leakage currents and dry band arcing can occur. Such conductive paths can result in degradation of the sheath. Similarly, the hydrophobic coating covers mold lines, which reduce the formation of conductive paths along the mold lines.

A non-continuous hydrophobic coating can be used to break conductive paths by forming intermittent surfaces on which water beads. The hydrophobic coating also provides the considerable advantage of forming a bond to the underlying sheath and sheds that make the coating difficult to scrape off accidentally. The hydrophobic coating may be reapplied as necessary to maintain a hydrophobic surface on the sheath and sheds. Periodically applying or reapplying the hydrophobic coating as part of a maintenance program lengthens the life of the housing.

Other features and advantages will be apparent from the description, the drawings, and the claims.

DESCRIPTION OF DRAWINGS

Like reference symbols in the various drawings indicate like elements.

DETAILED DESCRIPTION

Figure 1:
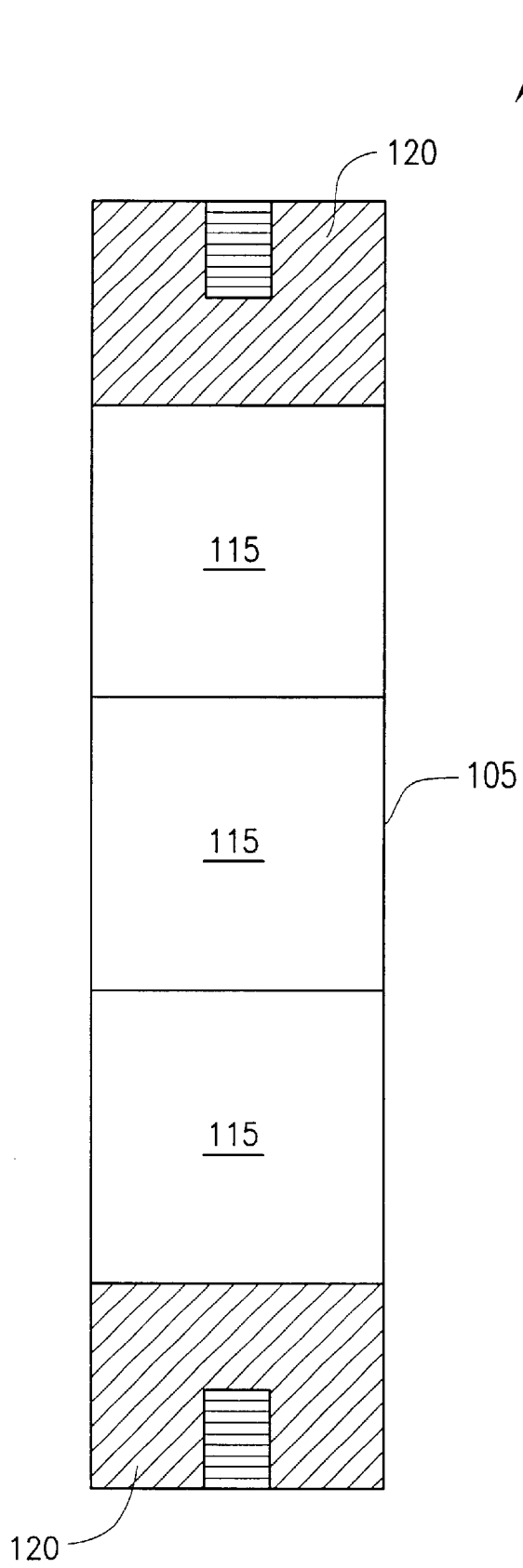
FIG. 1 is a cross-sectional side view of an electrical component module.
Figure 2:
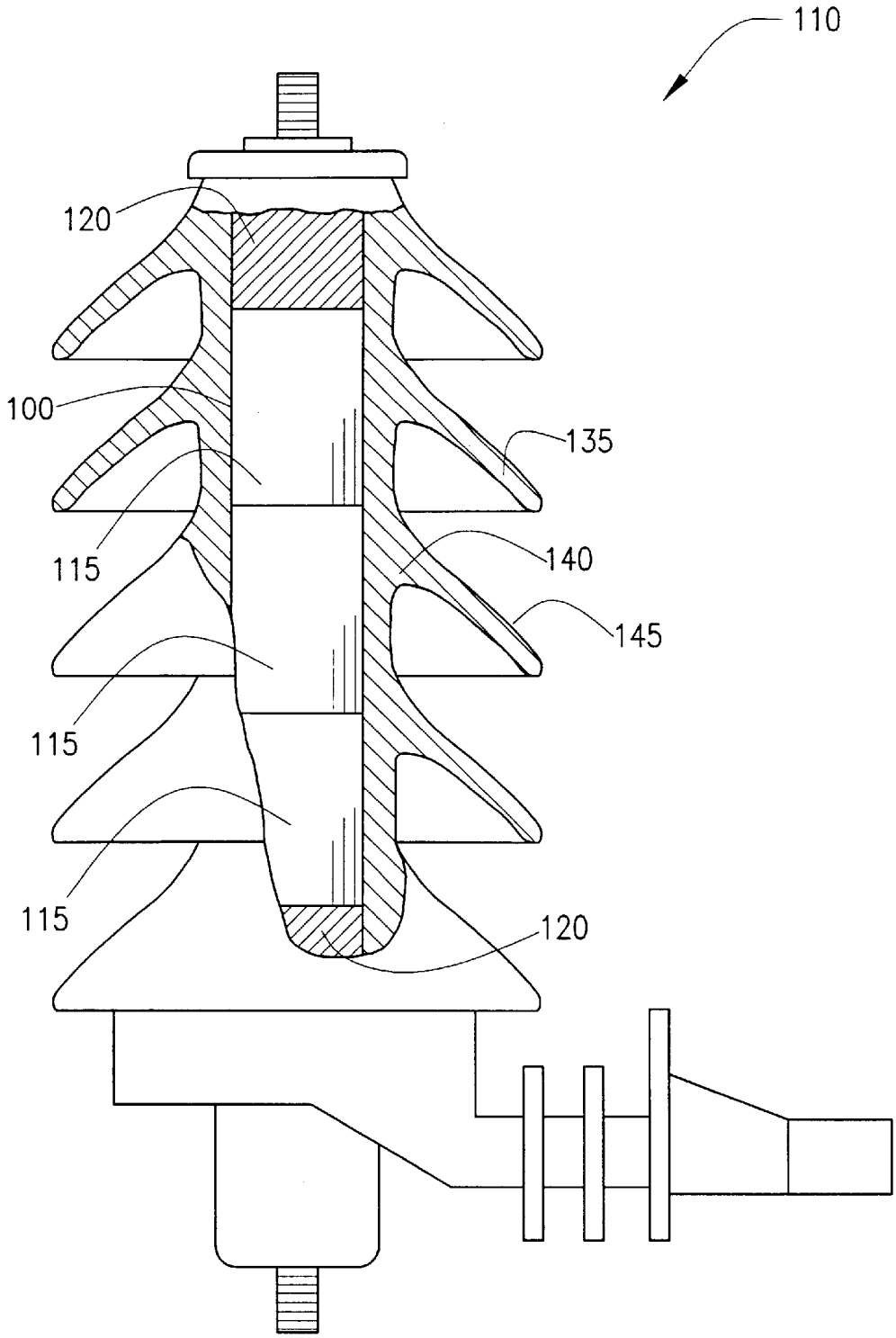
FIG. 2 is a partial cross-sectional side view of a surge arrester employing the module of FIG. 1.

Referring to FIGS. 1 and 2, an electrical component module 100 includes an element stack 105 that serves as both the electrically-active component and the mechanical support component of an electrical apparatus, such as a surge arrester 110. The stack 105 also exhibits high surge durability, in that it can withstand high current, short duration conditions, or other required impulse duties.

Elements of the element stack 105 are stacked in an end-to-end relationship. The element stack 105 may include different numbers of elements, and elements of different sizes or types. It should be understood, however, that the module 100 may be used in other types of surge arresters, and in other electrical insulating equipment. Examples include varistors, capacitors, thyristors, thermistors, resistors, and insulating members. For purposes of explanation, the stack is shown as including three metal oxide varistors ("MOVs ") 115 and a pair of terminals 120.

The element stack 105 is installed in a housing 135, which includes a sheath 140 and sheds 145. The housing 135 is made of an electrically insulating material, such as porcelain or a polymeric material, and protects the element stack 105 from environmental conditions. A polymeric housing can be coated with room temperature vulcanized ("RTV") silicone to provide a hydrophobic surface that causes water to bead on the surface of the housing rather than to form a continuous layer of water along the entire surface. By forming beads, i.e., discrete regions of water, leakage currents and dry band arcing from the surge arrester cannot travel the length of the housing, as would be the case if there was a continuous layer of water on the surface of the housing. Leakage currents and dry band arcing can cause degradation and eventual failure of the housing.

Figure 3:
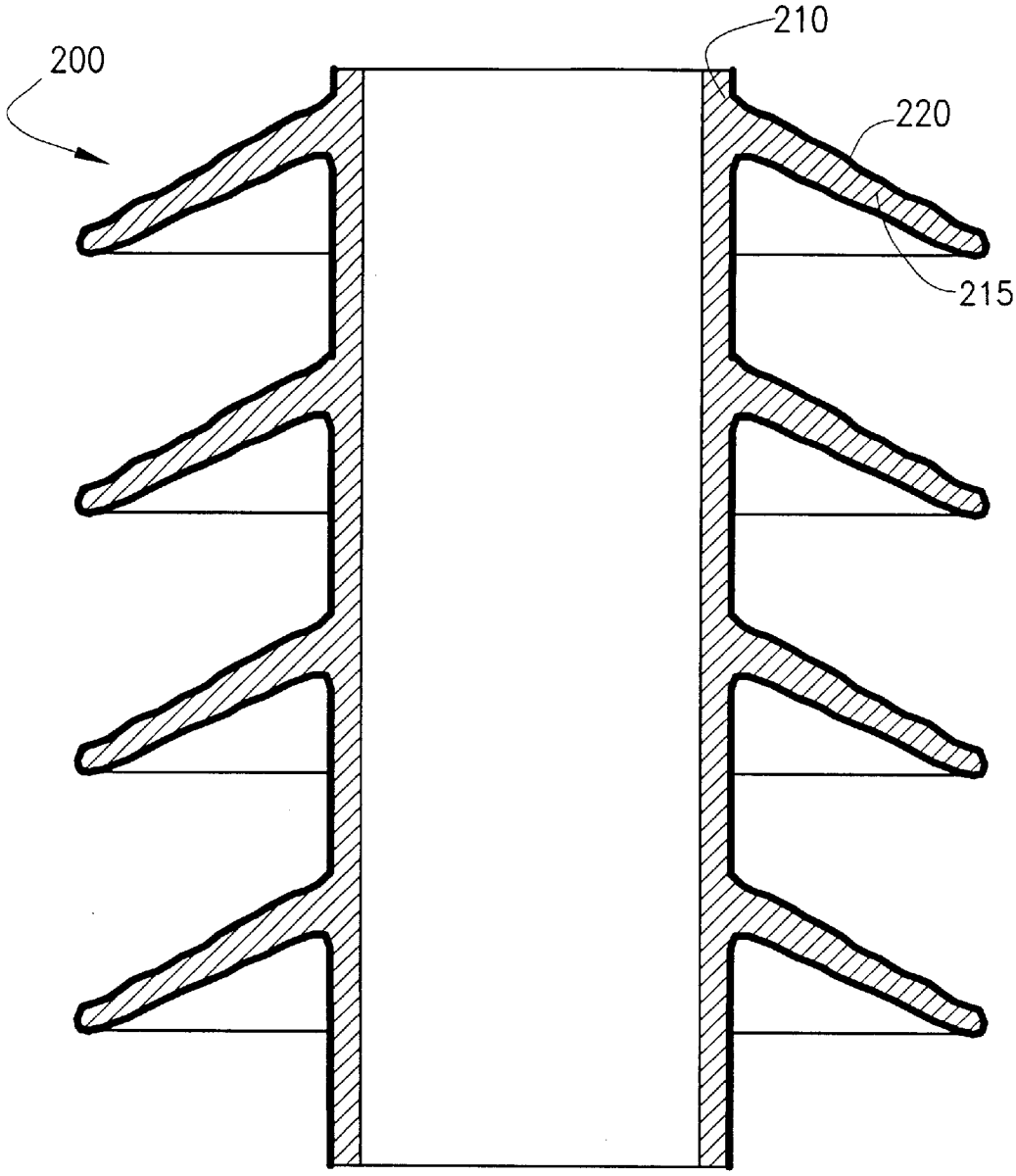
FIG. 3 is a cross-sectional side view of a housing with a continuous hydrophobic coating.

Referring to FIG. 3, a housing 200 with improved hydrophobic properties includes, for example, a high temperature vulcanized ("HTV") silicone sheath 210, multiple HTV silicone sheds 215, and a continuous RTV silicone coating 220 over the entire surface of the sheath 210 and the sheds 215. Although the housing 200 can be made entirely of HTV silicone, which is hydrophobic, the RTV silicone coating 220 provides a more hydrophobic surface on the housing 200 and thus water even more readily beads on the surface instead of forming a continuous layer of water between the ends of the shed. The ability to form water beads rather than a continuous layer of water is especially beneficial in a polluted environment in which the pollutants can dissolve in the water on the housing's surface, which increases the electrical conductivity of the water. Thus, in a polluted environment, an increase in the hydrophobicity of the housing's surface is likely to increase the longevity of the housing because there is a reduced ability to form a continuous flow path for leakage currents and dry band arcing. Although HTV silicone is hydrophobic, RTV silicone maintains and recovers its hydrophobicity more readily, which enhances the performance of the combined material system.

The housing 200 can be formed using conventional techniques, such as injection molding or machining to form the sheath 210 and the sheds 215. For example, the sheath 210 and the sheds 215 can be molded as separate components and the sheds then can be mounted on the sheath. The sheath 210 and the sheds 215 also can be molded as a single piece with the sheds 215 being integrally formed with the sheath 210. In either case, after the housing 200 is formed, the RTV silicone coating 220 is applied using conventional techniques, such as brushing, dipping, or spraying.

The RTV silicone coating 220 typically is thick enough to cover any mold lines or other surface features, such as pits, formed during the molding of the sheath 210 and shed 215. For example, the thickness of the RTV silicone coating may be between approximately 0.01 and 10 millimeters. The ability to cover surface features, such as mold lines, is advantageous to the longevity of the housing because surface features, such as mold lines, often result in an increased tendency for leakage currents and dry band arcing to form a flow path along the surface of the housing. Although the sheath 210 and the sheds 215 are described as being made from HTV silicone, they also can be made from a polymer concrete, a ethylene propylene rubber, or a combination of one or more of HTV silicone, polymer concrete, and ethylene propylene. Any of these materials then can be coated with the RTV silicone coating.

Figure 4:
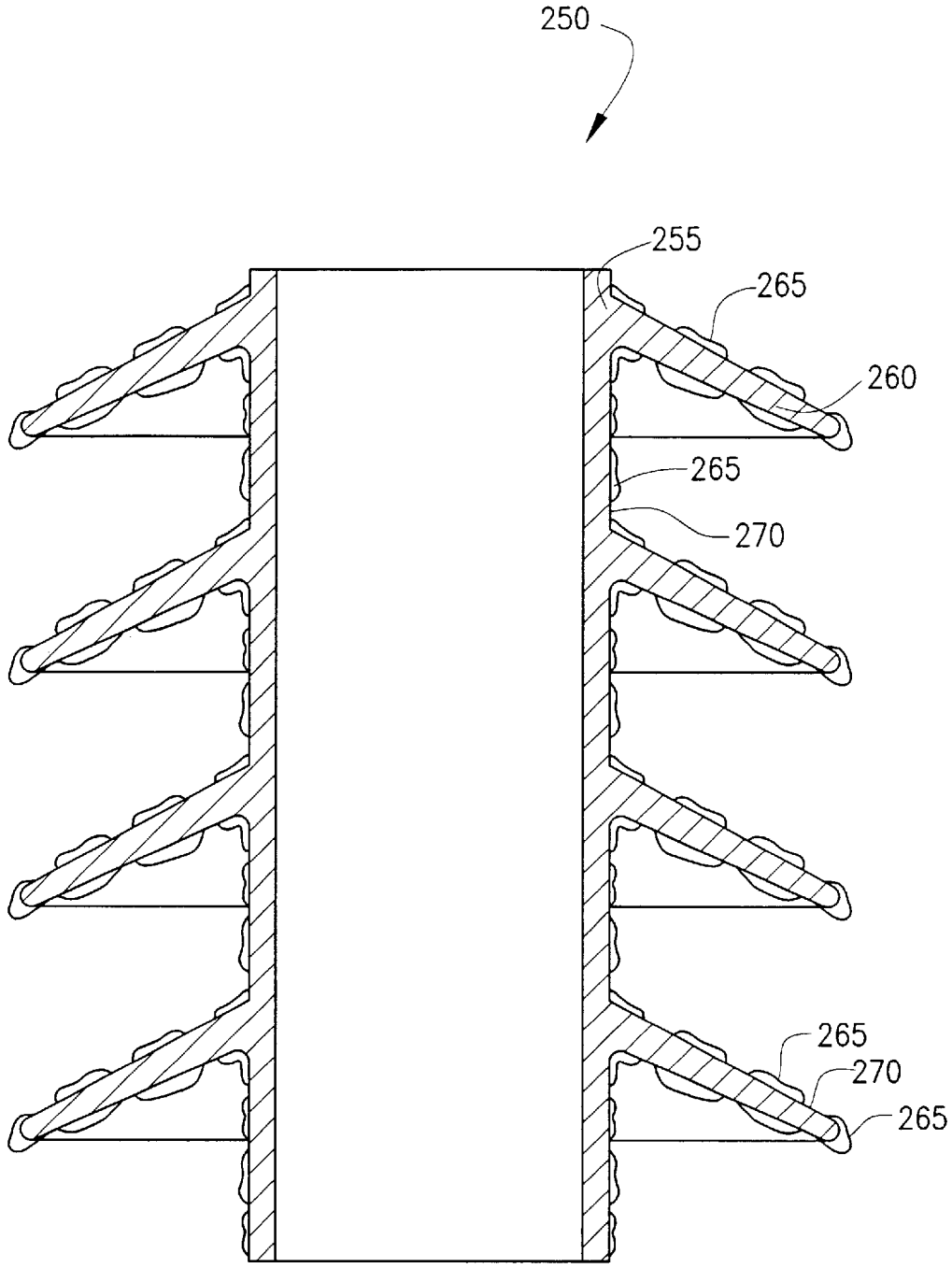
FIG. 4 is a cross-sectional side view of a housing with a non-continuous hydrophobic coating.
Figure 5:
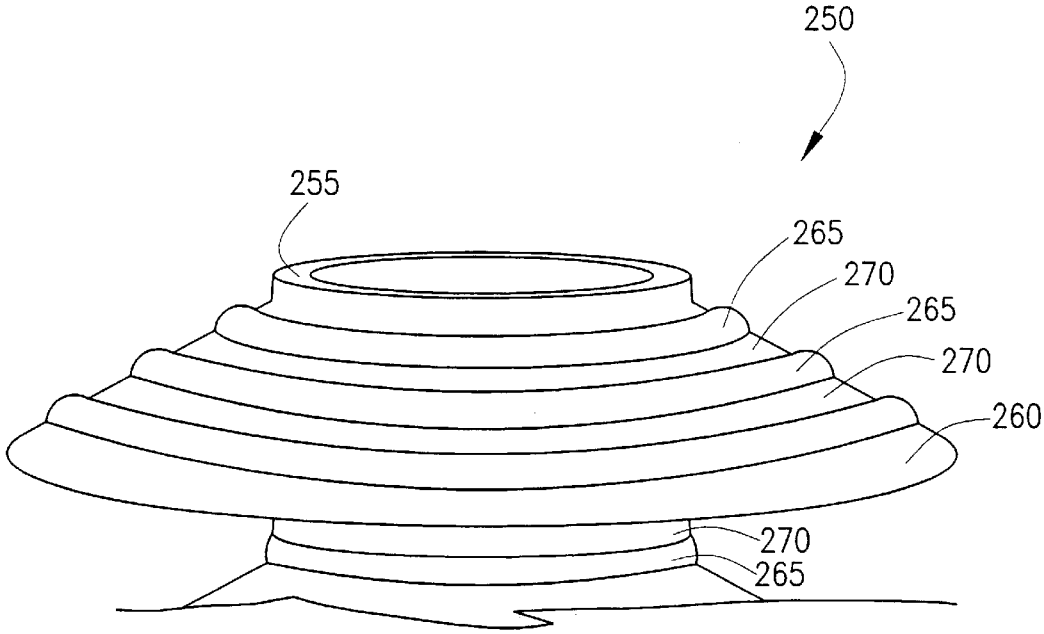
FIG. 5 is a perspective view of a single shed of the housing of FIG. 4.

Referring to FIG. 4, a housing 250 with improved hydrophobic properties includes a HTV silicone sheath 255, multiple HTV silicone sheds 260, and a non-continuous RTV silicone coating 265 over the surface of the sheath 255 and the sheds 260. The RTV silicone coating 265 is separated by non-coated regions 270. In this configuration, a continuous path for water to form on the HTV silicone surface (i.e., non-coated regions 270) is broken by the non-continuous RTV silicone coating 265.

To generalize, the housings 200 and 250 with improved hydrophobic properties include an electrically insulative sheath and shed that are coated with a coating having hydrophobic properties to prevent or reduce the occurrence of paths for leakage currents or dry band arcs to form. Many variations in design are possible to achieve this effect. For example, a housing with improved hydrophobic properties can be formed by coating HTV sheath and sheds with a coating of liquid silicone ("LS") rubber. Like the RTV silicone rubber coatings described above, the LS rubber coating can be continuous or non-continuous over the surfaces of the sheath and shed.

A housing with improved hydrophobic properties also can be formed by fabricating the sheath and sheds from a mixture of RTV silicone and HTV silicone. Such a housing then can be optionally coated with LS rubber or RTV silicone. Like the RTV silicone rubber coatings described above, the LS rubber or RTV silicone coating can be continuous or non-continuous over the surfaces of the sheath and shed.

A housing with improved hydrophobic properties also can be formed by fabricating the sheath and sheds from an electrically insulative material such as an ethylene-propylene-based material, an ethylene vinyl acetate, a cycloaliphatic resin, and an elastomeric or polymeric insulative material and coating the sheath and sheds with a hydrophobic material, such as RTV silicone or LS rubber. The coating can be continuous or non-continuous over the surface of the sheath and sheds. In a modification of this design, the sheath can be formed from one or more of the electrically insulative materials described above and the sheds can be formed from a hydrophobic material, such as RTV or HTV silicone. The sheath can be optionally coated with a hydrophobic material, such as RTV silicone or LS rubber.

Figure 6:
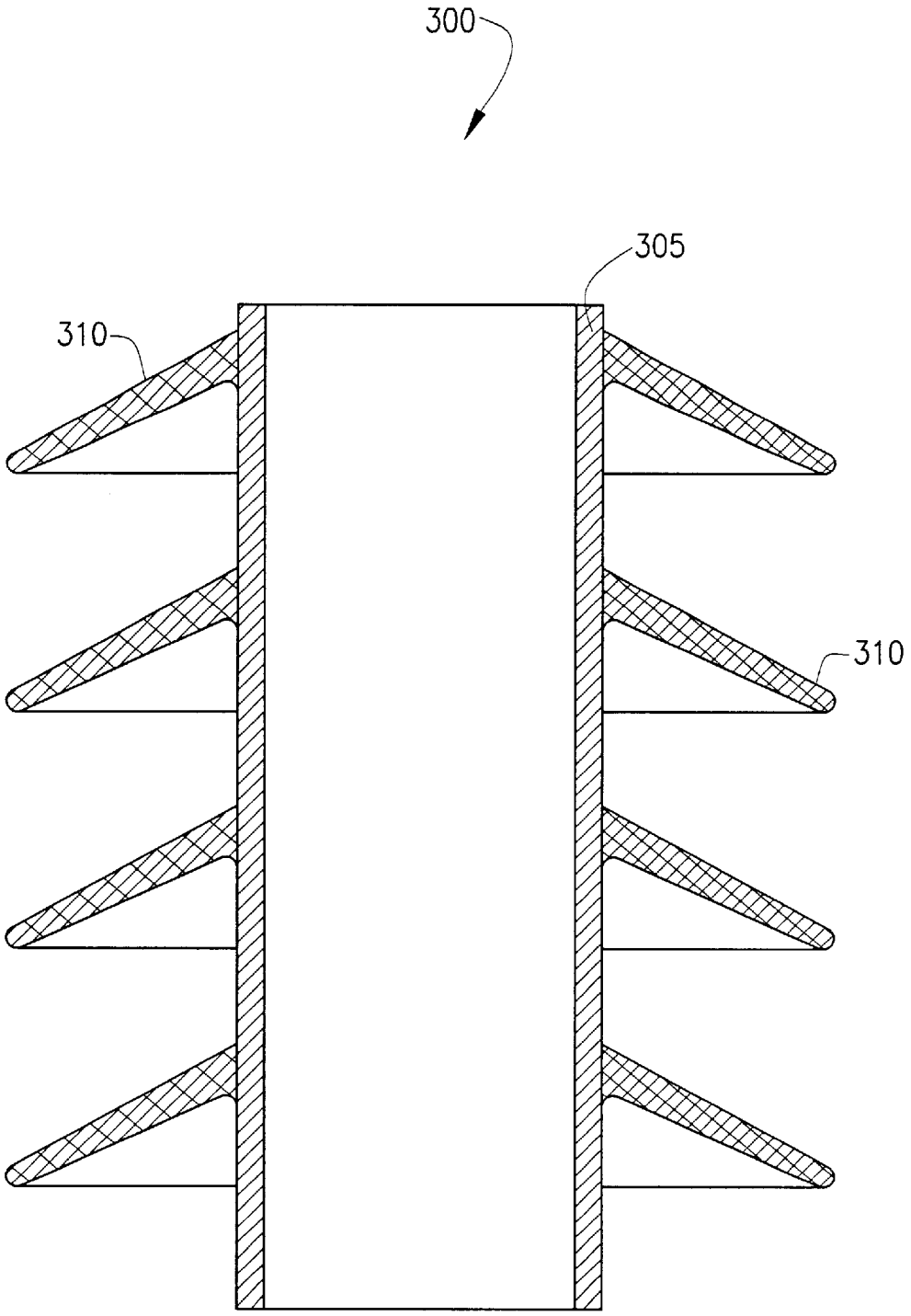
FIG. 6 is a cross-sectional side view of an exemplary housing that includes a HTV silicone sheath and RTV silicone sheds.

Referring to FIG. 6, an improved housing 300 includes a HTV silicone sheath 305 and RTV silicone sheds 310. The intermittent placement of the sheds 310 along the length of the HTV silicone sheath 305 breaks up the possible continuous paths for current to flow because the water will form beads on the RTV silicone sheds 310 and reduce or eliminate the flow of an electrical current.

Figure 7:
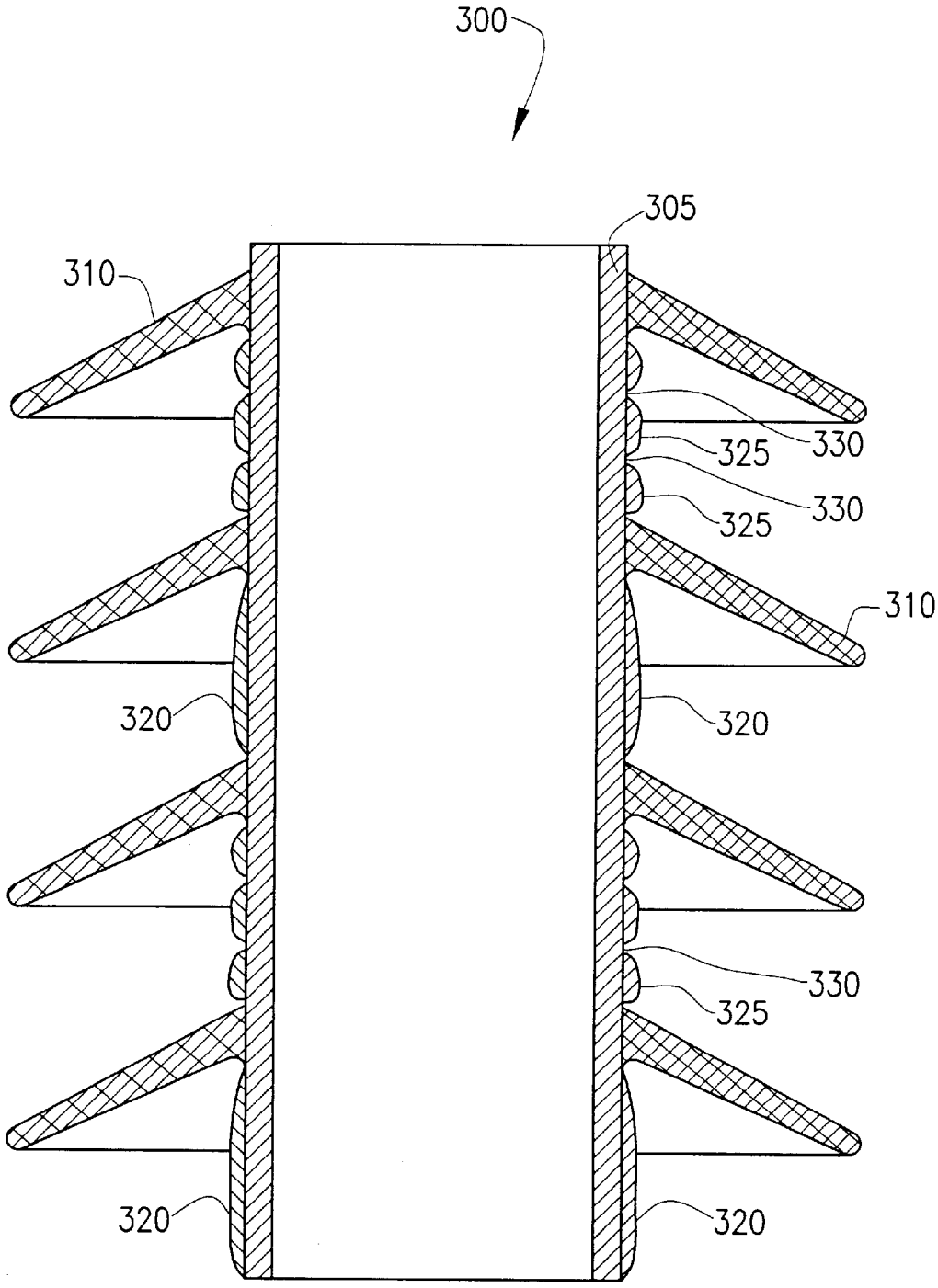
FIG. 7 is a cross-sectional side view of the housing of FIG. 6 with a coating applied to the sheath.

Referring also to FIG. 7, the HTV silicone sheath 305 can have a coating of a hydrophobic material, such as RTV silicone or LS rubber applied to the sheath's surface. The coating can be a continuous coating 320 or a non-continuous coating 325 which is separated by non-coated regions 330.

Figure 8:
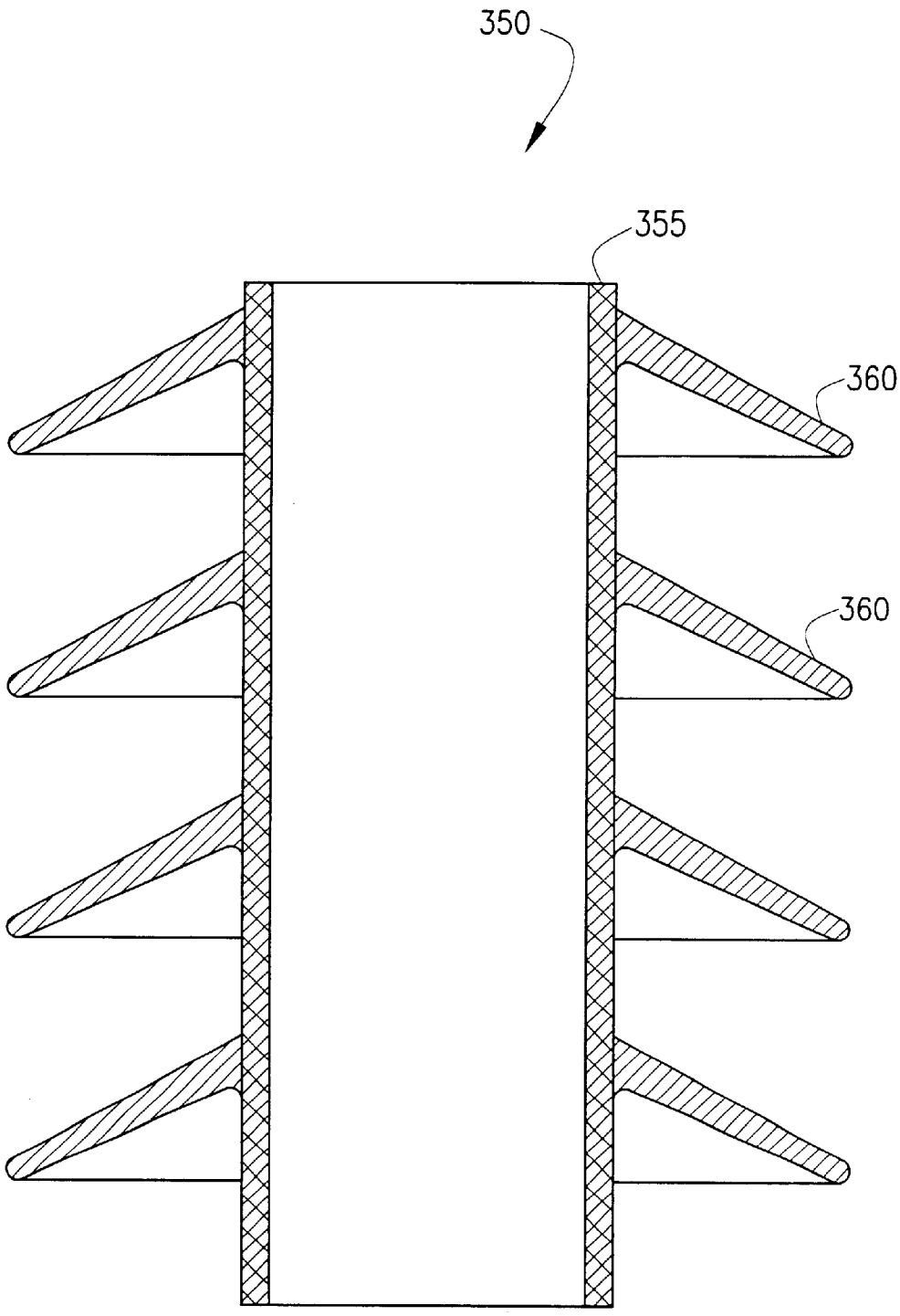
FIG. 8 is a cross-sectional side view of an exemplary housing that includes a RTV silicone sheath and HTV silicone sheds.

Referring to FIG. 8, an improved housing 350 includes a RTV silicone sheath 355 and HTV silicone sheds 360. Similarly to the housing 300, the intermittent placement of components of RTV silicone (i.e., the sheath 355) and HTV silicone (i.e., the sheds 360) breaks up the possible continuous paths for currents to flow because the water will form beads on the RTV silicone sheath 355 between each of the sheds 360.

Figure 9:
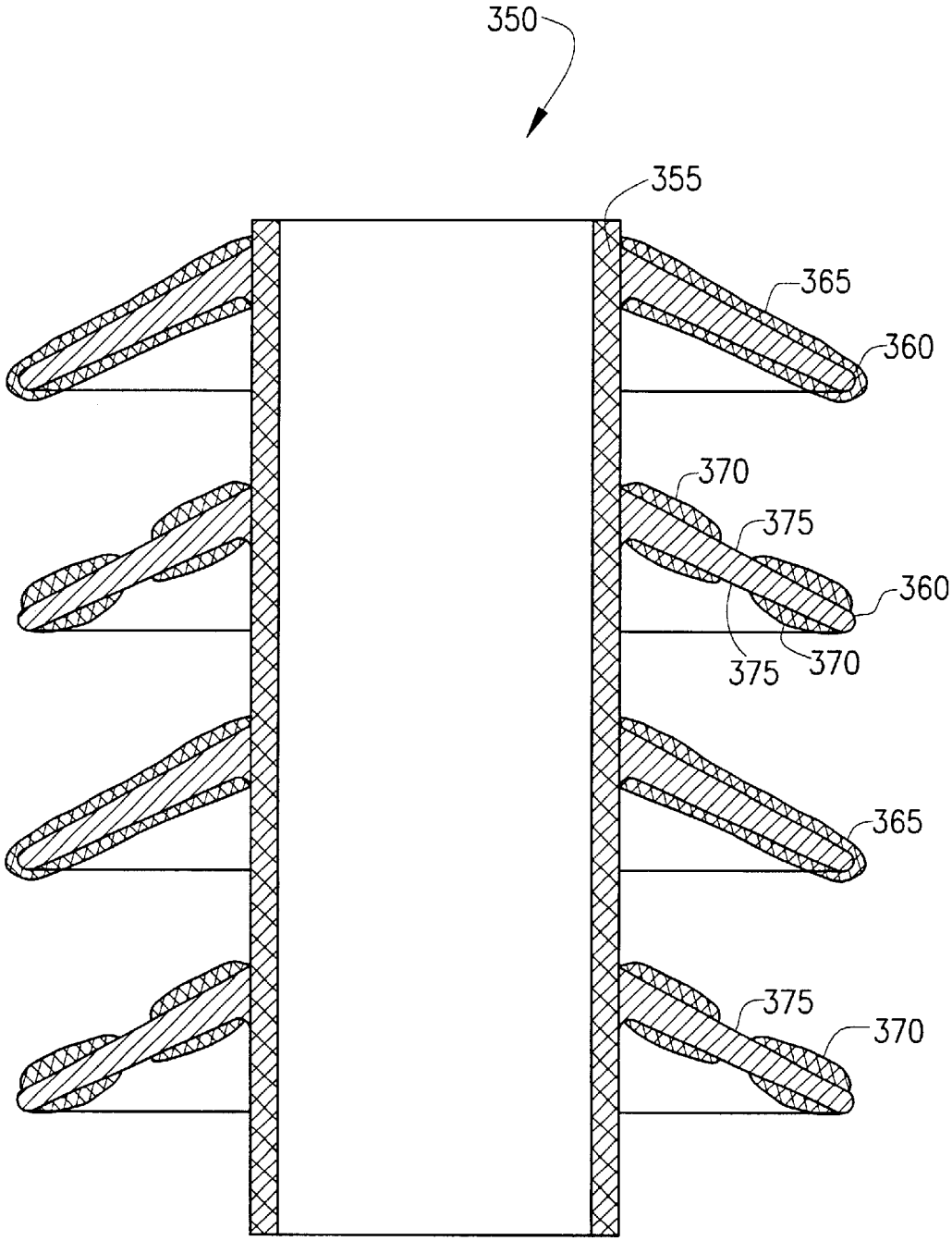
FIG. 9 is a cross-sectional side view of the housing of FIG. 8 with a coating applied to the sheds.

Referring also to FIG. 9, the HTV silicone sheds 360 can have a coating of a hydrophobic material, such as RTV silicone or LS rubber applied to the shed's surfaces. The coating can be a continuous coating 365 or a non-continuous coating 370 which is separated by non-coated regions 375.

Figure 10:
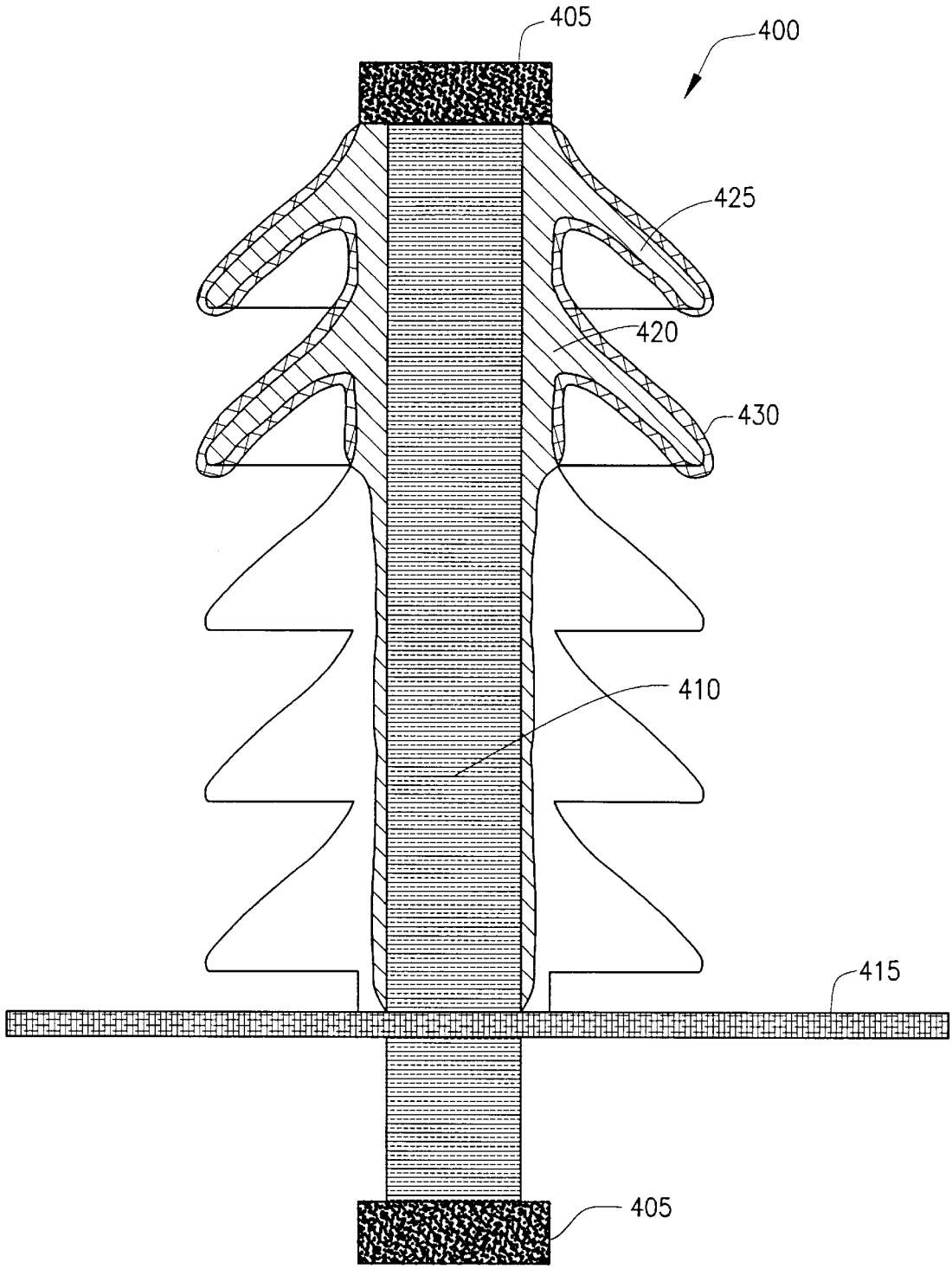
FIG. 10 is a cross-sectional side view of an electrical apparatus that includes a conductor core component that is enclosed by a housing having a hydrophobic coating.

Referring to FIG. 10, a conductor core component 400 includes a pair of mechanical end elements 405 and a conductive core structure 410, and extends through a device wall 415 of the device in which the conductor core component 400 is partially installed. The conductor core component 400 is enclosed by a sheath 420, sheds 425, and a hydrophobic coating 430. The mechanical end elements 405 are used to physically attach the conductor core component 400 to a cable or other support structure and can include, for example, threaded holes, threaded rods, eyes, clevises, yokes, saddles, and wireforms. The conductive core structure 410 may be, for example, a metal rod, a conductive polymer, a wire, or a cable. The conductor core component 400 can be used in, for example, a transformer, a capacitor, a switch, a recloser, a circuit breaker, and a feed through bushing. The sheath 420, the sheds 425, and the coating 430 can be made of any combination of the materials described above.

Figure 11:
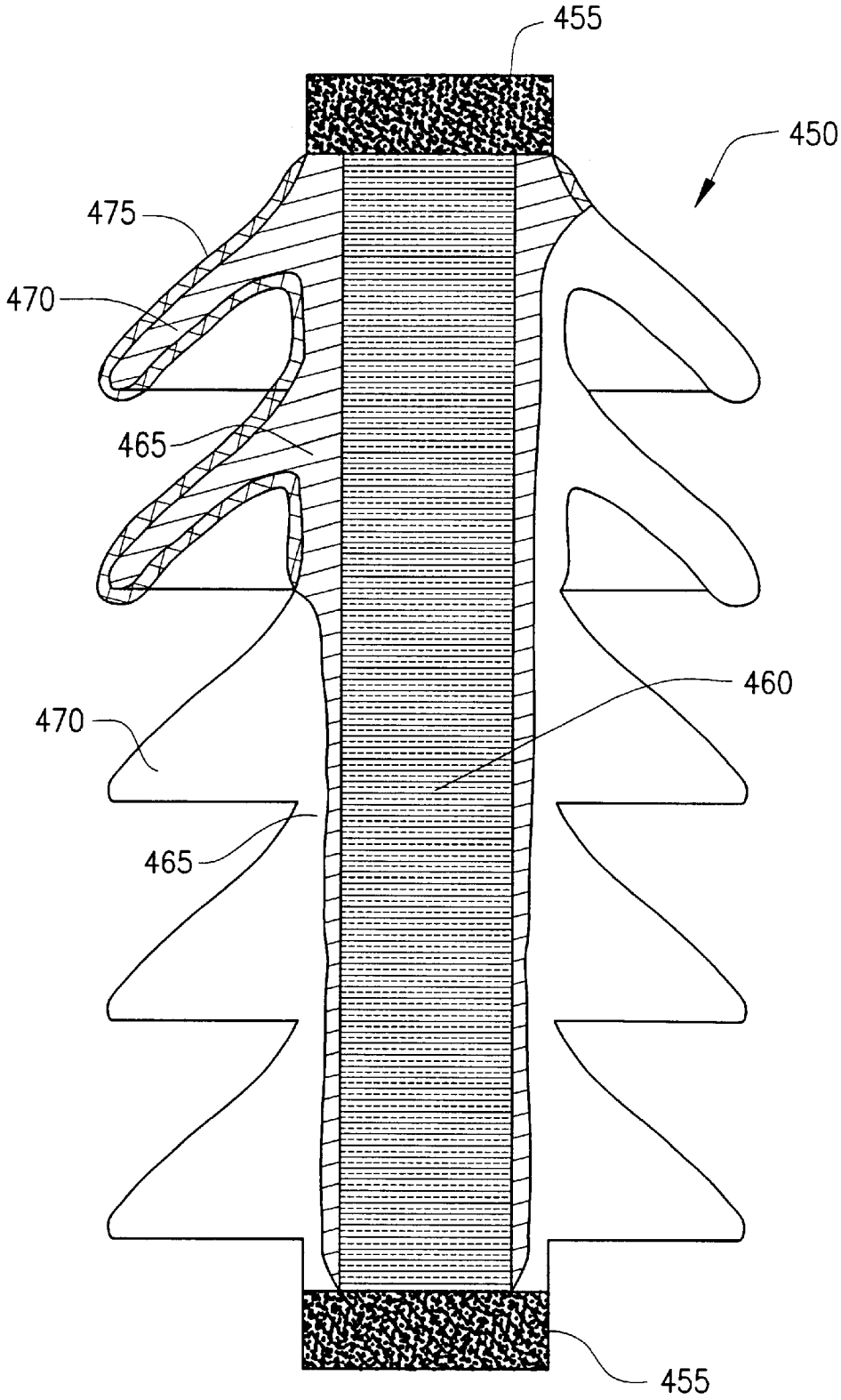
FIG. 11 is a cross-sectional side view of an electrical apparatus that includes an insulator core component that is enclosed by a housing having a hydrophobic coating.

Referring to FIG. 11, an insulator core component 450 includes a pair of mechanical end elements 455, an insulator core structure 460, a sheath 465, sheds 470, and a hydrophobic coating 475. The mechanical end elements 455 are used to physically attach the insulator core component 450 to a cable or other support structure and can include, for example, threaded holes, threaded rods, eyes, clevises, yokes, saddles, and wireforms. The insulator core structure 460 may be, for example, a fiberglass rod, an epoxy rod, a cycloaliphatic material, or other insulative composite material. The insulator core component 450 can be used in, for example, a suspension or string insulator, a dead ends insulator, a post insulator, a pin insulator, or a buss support. The sheath 465, the sheds 470, and the coating 475 can be made of any combination of the materials described above.

Any of the coating materials described above can be applied to the sheath and sheds enclosing the electrical apparatus after the electrical apparatus has been installed in the field. For example, a surge arrester can be constructed, coated and installed in the field. As a maintenance program, the surge arrester can be periodically recoated with any one of the coatings described above. The coating can be applied with a brush, a sprayer, or any other coating apparatus. In this manner, the life of the sheath and sheds enclosing the surge arrester can be extended. To assist in the maintenance of the electrical apparatus, the coating can be formulated with a pigment to color the coating with a color that is different from the color of the sheath and sheds so that a maintenance worker can easily determine the integrity of the coating by looking for breaks in the color of the coating. The coating, the applicator, and a set of instructions for using the coating and applicator can be packaged as a kit and sold or otherwise provided by the manufacturer of the surge arrester and/or the sheath and the sheds.

A number of implementations have been described. Nevertheless, it will be understood that various modifications may be made. For example, the sheaths, the sheds, and the coatings described above can be made of any combination of the materials described above. For example, the sheath can be made of porcelain and the sheds of a polymer, with the sheds being placed around the sheath. Similarly, the sheath can be made of a polymer and the sheds of porcelain, with the sheds being placed around the sheath. Likewise, although the improved hydrophobic coating, sheaths and sheds, and the performance improvements they provide, are described as being implemented on a number of devices, they can be applied to any electrical or other apparatus using an insulator. Accordingly, other embodiments are within the scope of the following claims.

What is claimed is:

1. A housing for an electrical apparatus comprising:

a sheath comprising a first electrically insulative material and having an outer surface;

at least one shed comprising a second electrically insulative material and having an outer surface; and a hydrophobic coating applied to the outer surface of at least one of the sheath and the at least one shed, wherein one of the first electrically insulative material and the second electrically insulative material comprises an electrically insulative polymeric material and wherein the hydrophobic coating has physical properties that are different from physical properties of the first electrically insulative material and the second electrically insulative material.

2. The housing of claim 1 wherein the sheath comprises a HTV silicone, the at least one shed comprises a HTV silicone and the coating comprises one or more of a LS rubber and a RTV silicone.

3. The housing of claim 2 wherein the coating forms a continuous surface on the outer surface of the sheath.

4. The housing of claim 2 wherein the coating forms a continuous surface on the outer surface of the at least one shed.

5. The housing of claim 2 wherein the coating forms a non-continuous surface on the outer surface of the sheath.

6. The housing of claim 2 wherein the coating forms a non-continuous surface on the outer surface of the at least one shed.

7. The housing of claim 1 wherein the sheath comprises a HTV silicone, the at least one shed comprises a RTV silicone and the coating comprises one or more of a LS rubber and a RTV silicone.

8. The housing of claim 7 wherein the coating comprises a continuous surface on the outer surface of the sheath.

9. The housing of claim 7 wherein the coating comprises a non-continuous surface on the outer surface of the sheath.

10. The housing of claim 1 wherein the sheath comprises a RTV silicone, the at least one shed comprises a HTV silicone and the coating comprises a LS rubber.

11. The housing of claim 10 wherein the coating comprises a continuous surface on the outer surface of the at least one shed.

12. The housing of claim 10 wherein the coating comprises a non-continuous surface on the outer surface of the at least one shed.

13. The housing of claim 1 wherein the first electrically insulative material comprises one or more of an ethylene-propylene-based material, an ethylene vinyl acetate, a cycloaliphatic resin, and an elastomeric or polymeric insulative material, and the coating comprises one or more of a LS rubber and a RTV silicone.

14. The housing of claim 13 wherein the coating forms a continuous surface on the outer surface of the sheath.

15. The housing of claim 13 wherein the coating forms a continuous surface on the outer surface of the at least one shed.

16. The housing of claim 13 wherein the coating forms a non-continuous surface on the outer surface of the sheath.

17. The housing of claim 13 wherein the coating forms a non-continuous surface on the outer surface of the at least one shed.

18. The housing of claim 1 wherein the second electrically insulative material comprises one or more of an ethylene-propylene-based material, an ethylene vinyl acetate, a cycloaliphatic resin, and an elastomeric or polymeric insulative material, and the coating comprises one or more of a LS rubber and a RTV silicone.

19. The housing of claim 18 wherein the coating forms a continuous surface on the outer surface of the sheath.

20. The housing of claim 18 wherein the coating forms a continuous surface on the outer surface of the at least one shed.

21. The housing of claim 18 wherein the coating forms a non-continuous surface on the outer surface of the sheath.

22. The housing of claim 18 wherein the coating forms a non-continuous surface on the outer surface of the at least one shed.

23. The housing of claim 1 wherein the electrical apparatus comprises one or more of a transformer, a capacitor, a switch, a recloser, a circuit breaker, a feed through bushing, a suspension insulator, a dead ends insulator, a post insulator, a pin insulator, and a buss support.

24. The housing of claim 1 further comprising a kit comprising the coating and a coating applicator wherein the kit is configured for use in applying the coating to the electrical apparatus after the electrical apparatus has been installed in the field.

25. A method of forming a housing for an electrical apparatus, comprising:

providing a polymer sheath comprising a first electrically insulative material and having an outer surface;

providing at least one polymer shed comprising a second electrically insulative material and having an outer surface; and applying a hydrophobic coating to the outer surface of at least one of the sheath and the at least one shed, wherein the hydrophobic coating has physical properties that are different from physical properties of the first electrically insulative material and the second electrically insulative material.

26. The method of claim 25 wherein the coating is applied to form a continuous surface on the outer surface of the sheath.

27. The method of claim 25 wherein the coating is applied to form a continuous surface on the outer surface of the at least one shed.

28. The method of claim 25 wherein the coating is applied to form a non-continuous surface on the outer surface of the sheath.

29. The method of claim 25 wherein the coating is applied to form a non-continuous surface on the outer surface of the at least one shed.

30. The method of claim 25 wherein the first electrically insulative material comprises HTV and the second electrically insulative material comprises HTV.

31. The method of claim 25 wherein the first electrically insulative material comprises HTV and the second electrically insulative material comprises RTV.

32. The method of claim 25 wherein the first electrically insulative material comprises RTV and the second electrically insulative material comprises HTV.

33. The method of claim 25 wherein one or both of the first electrically insulative material and the second insulative material comprises one or more of an ethylene-propylene-based material, an ethylene vinyl acetate, a cycloaliphatic resin, an elastomeric or polymeric insulative material, and the coating comprises one or more of a LS rubber and a RTV silicone.

34. The method of claim 25 wherein the first electrically insulative material comprises one or more of an ethylene-propylene-based material, an ethylene vinyl acetate, a cycloaliphatic resin, and an elastomeric or polymeric insulative material, the second insulative material comprises HTV silicone, and the coating comprises one or more of a RTV silicone and a LS rubber.

35. The method of claim 25 wherein the electrical apparatus comprises one or more of a transformer, a capacitor, a switch, a recloser, a circuit breaker, a feed through bushing, a suspension insulator, a dead ends insulator, a post insulator, a pin insulator, and a buss support.

36. The method of claim 25 further comprising applying the coating to the electrical apparatus after the electrical apparatus has been installed.

37. The method of claim 25 further comprising periodically applying the coating to the electrical apparatus as part of a maintenance program.

38. A housing for an electrical apparatus comprising:

a polymer sheath comprising an electrically insulative polymeric material and having an exposed outer surface;

at least one polymer shed integrally attached to the sheath and comprising the electrically insulative polymeric material and having an exposed outer surface; and a hydrophobic RTV silicone coating applied to the exposed outer surface of the sheath and the at least one shed.

39. The housing of claim 38 wherein the electrically insulative polymeric material comprises one or more of a HTV silicone, a polymer concrete, and a ethylene-propylene rubber.

40. A method of maintaining a housing for an electrical apparatus comprising a polymer sheath and at least one polymer shed, the method comprising:

providing a hydrophobic coating; and applying the hydrophobic coating to at least one of the polymer sheath and the polymer shed, wherein the hydrophobic coating has physical properties that are different from physical properties of the first electrically insulative material and the second electrically insulative material.

41. The method of maintaining a housing of claim 40 wherein the coating includes a pigment that colors the coating a first color that is different from a second color of the polymer sheath and maintaining the housing further comprises determining the integrity of the coating by looking for breaks in the first color of the coating.

* * * * *